US006082254A

United States Patent [19]

De Vlaam

[11] Patent Number: 6,082,254

[45] Date of Patent: Jul. 4, 2000

[54] METHOD AND DEVICE FOR STRAPPING INDIVIDUAL OBJECTS OR STACKS OF OBJECTS

[75] Inventor: Henk De Vlaam, Almere, Netherlands

[73] Assignee: Ferag Verpakkingstechniek B.V., Lb Soest, Switzerland

[21] Appl. No.: 09/110,238

[22] Filed: Jul. 6, 1998

[30] Foreign Application Priority Data

Jul. 9, 1997 [CH] Switzerland ..... 1674/97

[51] Int. Cl.[7] ..... B65B 13/02

[52] U.S. Cl. ..... 100/2; 53/399; 53/575; 53/582; 100/11; 100/29

[58] Field of Search ..... 100/2, 11, 17–24, 100/29, 32, 33 PB; 53/399, 586, 590, 575, 582

[56] References Cited

U.S. PATENT DOCUMENTS

| | | | |
|---|---|---|---|
| 2,612,833 | 10/1952 | MacChesney | 53/590 |
| 4,520,720 | 6/1985 | Urban et al. . | |
| 4,782,648 | 11/1988 | Van Ottele | 53/586 |

FOREIGN PATENT DOCUMENTS

| | | |
|---|---|---|
| 2648784 | 12/1990 | France . |
| 2550025 | 11/1976 | Germany . |
| 3814029 | 9/1991 | Germany . |
| 4337714 | 5/1995 | Germany . |

*Primary Examiner*—Stephen F. Gerrity
*Attorney, Agent, or Firm*—Birch, Stewart, Kolasch & Birch, LLP

[57] ABSTRACT

For strapping substantially parallelepipedic objects or stacks which are conveyed into a strapping position and out of this position after strapping, a strapping tape extending in a starting position substantially straight from one side of the conveying path to the opposite side is formed into a tape bow with the help of two tape positioning devices arranged on the two opposite sides of the conveying path. Then, the object to be strapped is conveyed into the tape bow and the tape is tensioned around the object and is closed around the object and cut off the tape supply in the region of its starting position such that the object is strapped and the tape is again in its starting position. By adapting the size of the tape bow according to the format of an object to be strapped, the tape does not have to be pulled back for tensioning it around the object or stack. Therefore, the device is simple and the time required for strapping is short.

15 Claims, 6 Drawing Sheets

METHOD AND DEVICE FOR STRAPPING INDIVIDUAL OBJECTS OR STACKS OF OBJECTS

BACKGROUND OF THE INVENTION

1. Field of the Invention

The present invention is in field of the packaging technology and concerns a method and a device according to the generic terms of the corresponding independent claims. The method and the device serve for strapping substantially parallelepipedic objects or stacks of objects, the objects or stacks being conveyed into a strapping position, being stopped there and strapped and then being conveyed out of the strapping position.

2. Description of the Prior Art

It is known to strap, in a strapping position, substantially parallelepipedic objects or stacks perpendicular to the conveying direction by positioning a loop of tape drawn from a storage reel in a tape channel arranged in the form of a loop around the conveying path, by pulling the tape out of the channel and thus placing it around the object and by tensioning and closing the tape loop and by cutting the tape loop off the tape on the storage reel. The strapped object is then conveyed out of the strapping position.

Devices with tape channels for carrying out the transverse strapping as briefly described above are e.g. described in the publications U.S. Pat. No. 4,520,720 or DE-3814029. Such devices are used in many applications and the strapping produced meets the required standards.

One disadvantage of the known devices for transverse strapping is the fact that they are complicated and require a large number of movable components. The tape channel must be closed over its whole length for introducing the tape loop and must be opened for extracting the tape loop and is therefore a very complex device component. If, in addition, the device is to be used with a strapping material having a stiffness insufficient to be pushed into the tape channel the tape channel, becomes even more complex.

A further disadvantage of the known devices with a tape channel is the fact that the strapping process is not adaptable to different formats of objects to be strapped. The tape loop to be prepared for each strapping cycle is of the same size independent of the format of the object to be strapped. This means that when strapping smaller objects a longer length of tape must be pulled back which increases the cycle time.

SUMMARY OF THE INVENTION

The object of the present invention is to create a method and a device for strapping objects or stacks of objects, whereby the disadvantages of the known methods and devices as named above are to be omitted. The inventive method and the inventive device are than known devices and methods and they are to be applicable without the above disadvantages for strapping a sequence of objects having very different formats, especially very different heights.

This object is achieved by the method and the device as defined by the claims.

According to the inventive method, the strapping tape is positioned in a starting position in which it extends substantially in a straight line from one side of the conveying path to the opposite side and is then formed into a bow with the help of two tape positioning means arranged on the mentioned opposite sides of the conveying path. An object to be strapped is then conveyed into the tape bow and the tape is tensioned around the object or stack and is closed (e.g. by means of welding) and cut in the region of its starting position such that the object is tightly strapped and the tape is again in its starting position.

In the starting position, the tape extends e.g. below the conveying path and substantially perpendicular to it and the tape bow is formed by lifting the tape. The tape may lie in a substantially vertical plane such that the strapping is a transverse strapping (plane of the strapping perpendicular to the conveying path). Vertical or horizontal parallel strappings (plane of the strapping parallel to conveying path) are made in the same manner starting from a tape starting position in which the tape extends vertically or horizontally across the middle of the conveying path and a bow is formed with the tape lying in a plane parallel to the conveying path.

The bow formed of the tape with the help of the tape positioning means is adapted to the object or stack to be strapped by corresponding control of the tape positioning means such that the additional length of tape required for the bow compared to the starting position is in no case more than the length of tape required for the strapping. Therefore, the device does not require means for pulling back tape for tensioning it around thee object, which makes the device simple and the cycle time short. Furthermore, as is yet to be shown, the tape positioning means are considerably simpler in design than a known tape channel. Therefore, for two reasons the inventive device is more simple than strapping devices with a tape channel according to the state of the art.

A further advantage of the inventive method and the inventive device is the fact that they are applicable in the same manner with strapping tapes of very small stiffness, i.e. strapping tapes which could not be pushed into a tape channel for forming a tape loop. Furthermore, it is possible to use tapes with a quality which is considerably inferior concerning constancy of length and thickness compared to the materials to be used on devices with a tape channel.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

By means of the following Figures the inventive method and exemplified embodiments of the inventive device are explained more in detail, whereby.

DESCRIPTION OF THE PREFERRED EMBODIMENTS

Figure 1:
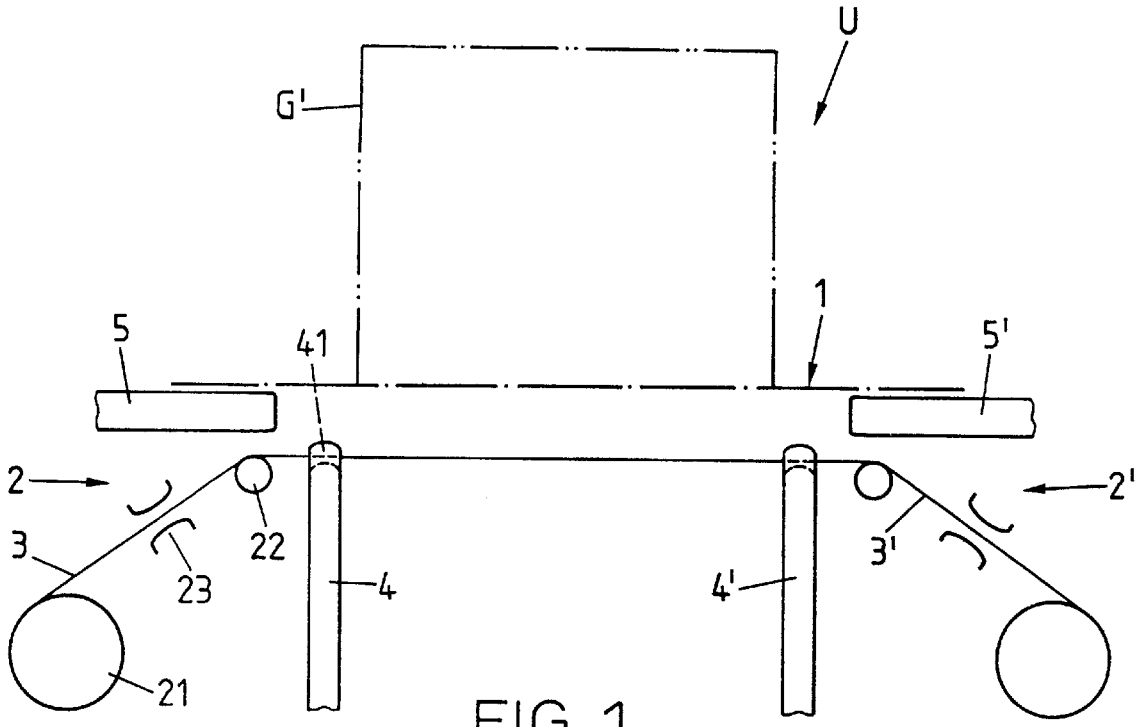
FIGS. 1 to 6 show successive phases of a cycle for transverse strapping (perpendicular to the conveying path or conveying direction) according to the inventive method.

FIGS. 1 to 6 show successive phases of a strapping cycle (transverse strapping) according to the inventive strapping method by means of a very diagrammatically represented embodiment of the inventive device. FIGS. 1 to 6 show the device viewed parallel to the conveying path on which the objects to be strapped are conveyed into the strapping position U and out of this position. The conveying direction is oriented perpendicular to the paper plane of the Figures.

The main elements of the inventive device and their functions are (FIG. 1):

- a conveying means 1 (e.g. an arrangement of conveying belts which are shown diagrammatically with broken lines representing a supporting surface) with the help of which an object or stack to be strapped is conveyed into the strapping position U and out of this position after strapping, whereby the supporting surface of the conveying means 1 comprises a gap extending across the conveying path, which gap is opened at least during strapping;
- two tape supply means 2 and 2' (e.g. storage reel 21, guiding reel 22 and a pair 23 of clamping or braking jaws) for supplying the strapping tape 3 and 3' to the strapping position and for tensioning the tape (between storage reel 21 and the pair 23 of clamping jaws a tape storage can be arranged in known manner e.g. in the form of dancer rolls) which tape supply means are arranged on opposite sides of the conveying path;
- two tape positioning means 4 and 4' positioned on the same opposite sides of the conveying path and each having a distal end which is displaceable substantially vertically for forming the tape bow and comprising a tape guide 41 (e.g. a groove as shown or a guiding roll with its axis arranged perpendicular to the tape);
- two tape-tensioning-closing-cutting-means 5 and 5' arranged below the supporting surface of the conveying means (e.g. as described in publication EP-0592049, Endra) for tensioning the tape around the object to be strapped, for closing the tape around the object and for cutting the tape closed around the object such that the tape from the storage reels is again positioned in the staring position;
- control means (not shown) for controlling the conveying means 1, the tape supply means 2 and 2', the tape positioning means 4 and 4' and the tape-tensioning-closing-cutting-means 5 and 5' such that they carry out the inventive strapping method.

A strapping cycle substantially consists of the successive phases which are shown in the FIGS. 1 to 6.

FIG. 1 shows the starting position: the strapping tape 3/3' extends below the supporting surface or the conveying path (in the region of the gap in the conveying belts) in a substantially straight line and perpendicular to the conveying path from one side of the conveying path to the opposite side or from the tape supply means 2 arranged beside the conveying path to the tape supply means 2' arranged on the opposite side of the conveying path. The object to be strapped is not yet in the strapping position. Its dimensions, as far as relevant for the strapping (dimensions of the conveying path to be kept clear for the next object to be strapped) are shown by means of broken lines G'. The tape positioning means 5 and 5' are in their starting position such that the tape 3/3' extends in its starting position unhindered by these means.

Figure 2:
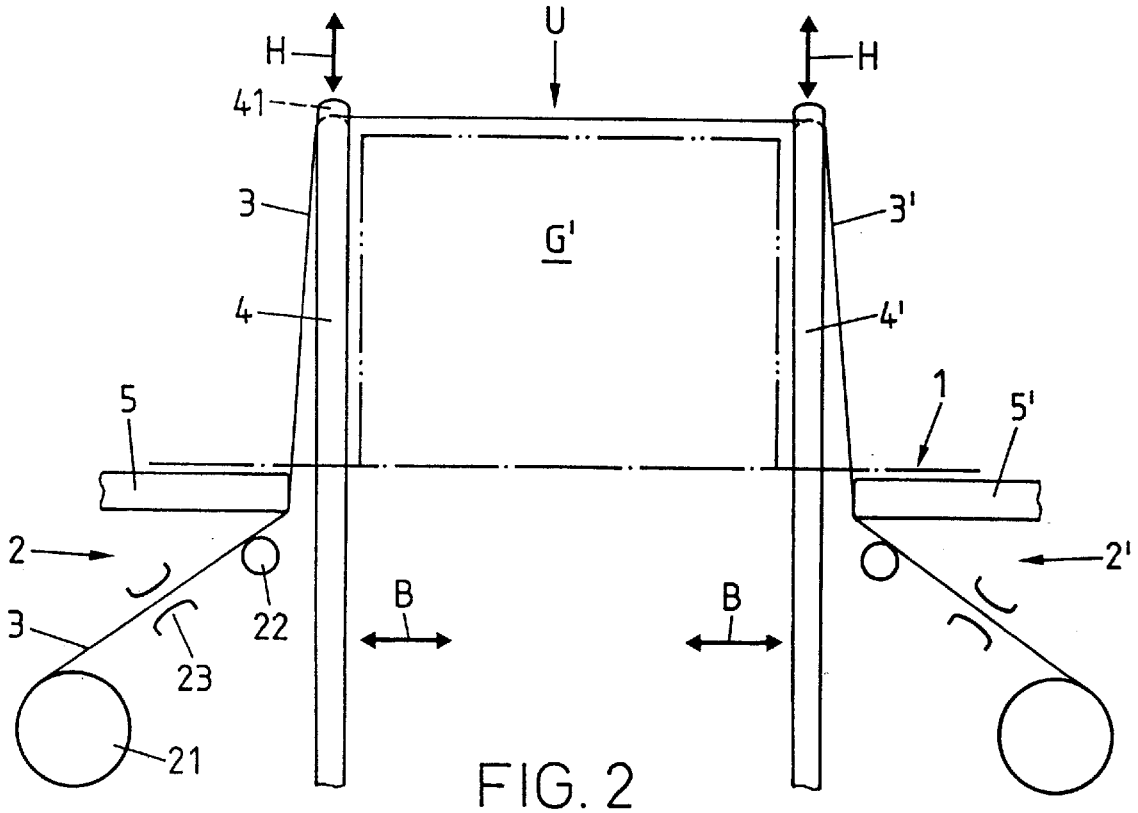

FIG. 2 shows the tape bow created for the transverse strapping. For creating this bow, the strapping tape 3/3' is raised by a corresponding stroke of the tape positioning means 4 and 4' such that the tape is positioned around the conveying path in the form of an arc and not obstructing the conveying path. For creating the tape bow, the tape 3/3' is supplied substantially without braking from the tape supply means 2 and 2'. The stroke of the tape positioning means 4 and 4' is dimensioned (arrows H) such that the tape bow is slightly higher than the next object to be strapped.

It is also possible not only to adapt the height of the tape bow to the height of the object to be strapped by corresponding raising of the distal ends of the tape positioning means 4 and 4', but also its width. This can be done by shifting the tape positioning means in order to change the distance between the two tape guides (arrow B).

Figure 3:
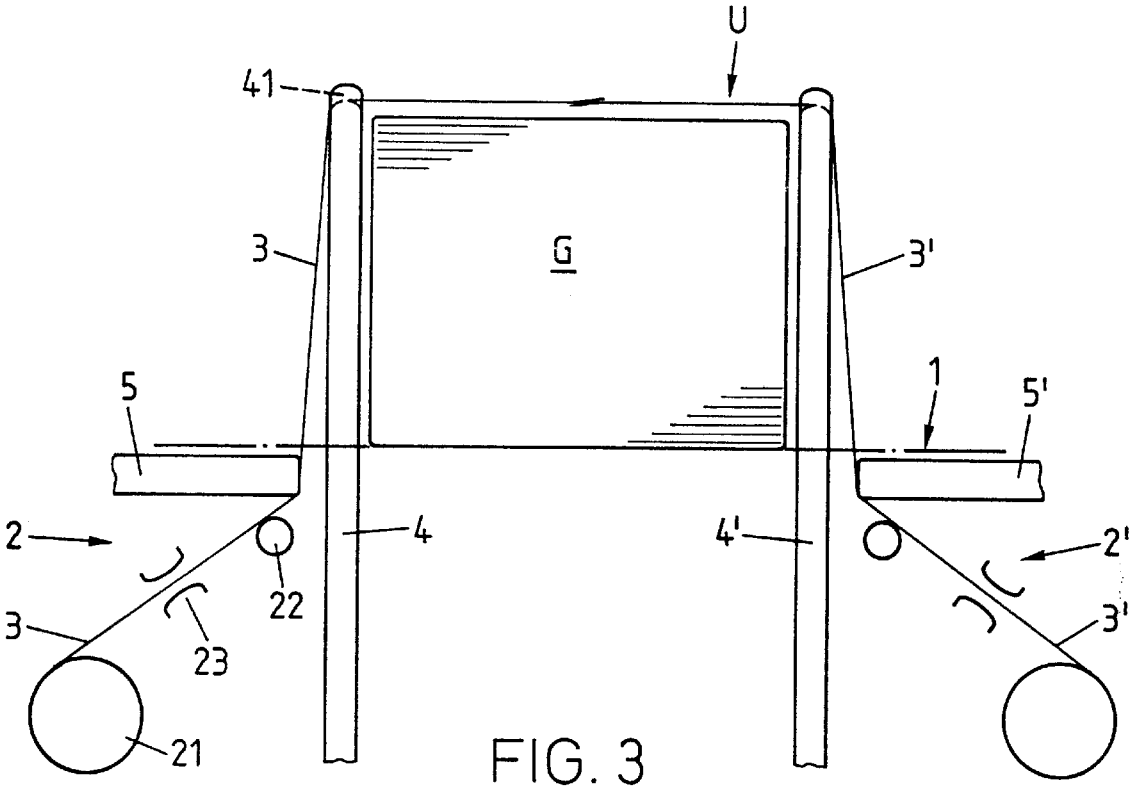

FIG. 3 shows the object G to be strapped which is positioned in the strapping position U, i.e. under or in the tape bow extended around the conveying path.

Figure 4:
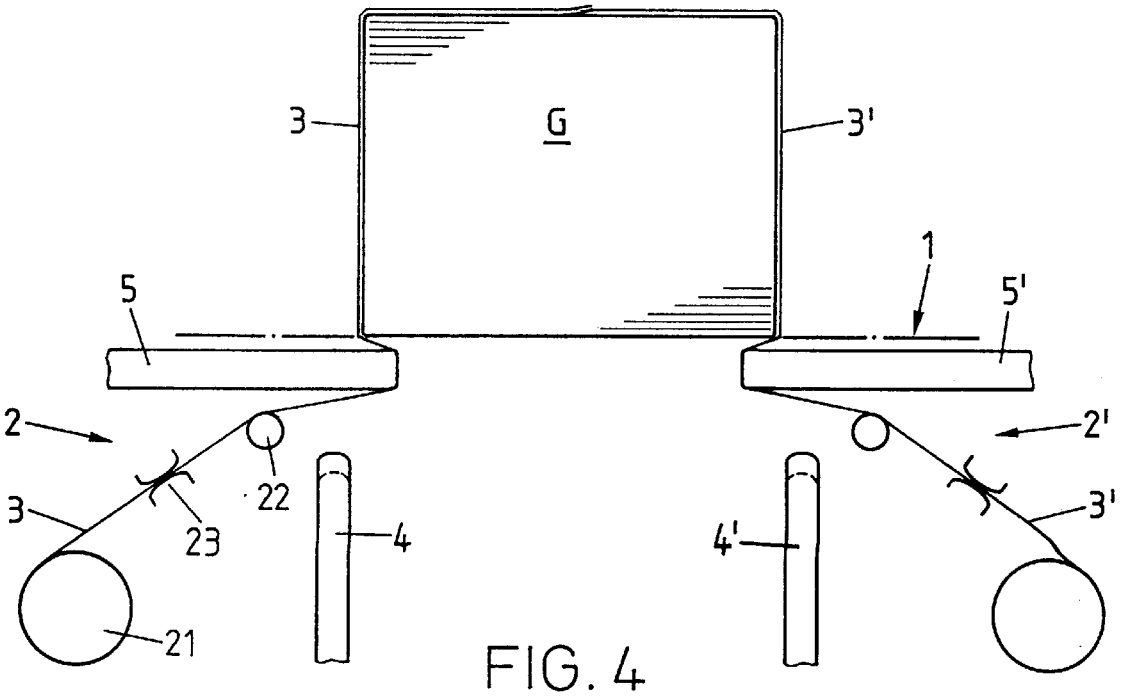

FIG. 4 shows the tape positioning means 4 and 4' repositioned in their starting position such that the tape 3/3' lies on the object G to be strapped. The tape-tensioning-closing-cutting-means 5 and 5' are moved towards each other, whereby they take with them the tape, the supply of which is now braked for tensioning it.

Figure 5:
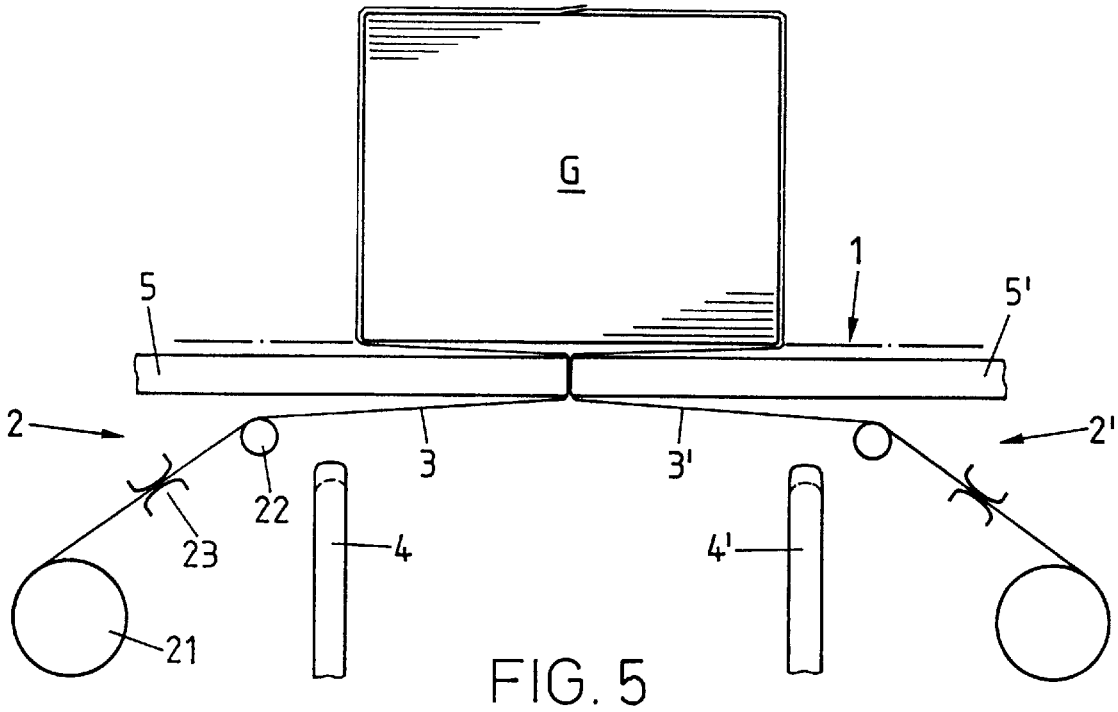

FIG. 5 shows the tape-tensioning-closing-cutting-means 5 and 5' which have met and are initiated for closing and cutting the tape such that it is positioned around the object, is closed (e.g. by means of welding) to form a strapping, and is cut off the tape supply such that the two tape ends are connected again.

Figure 6:
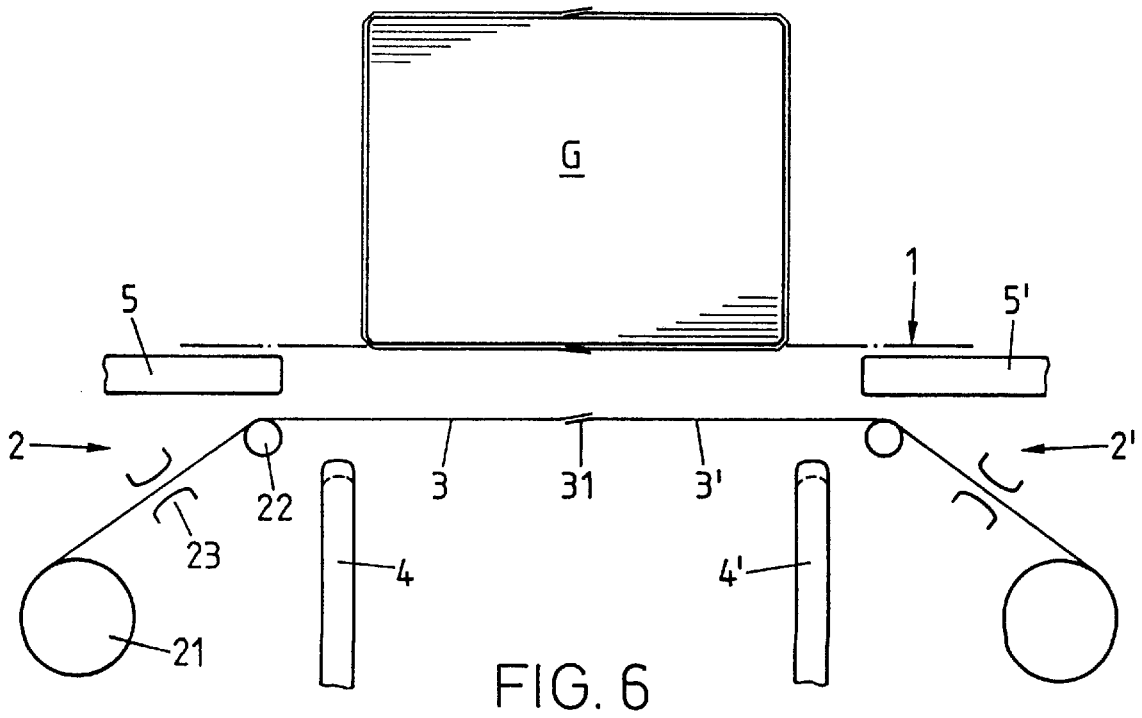

FIG. 6 shows the object G with a completed strapping and the strapping tape 3/3' connected in point 31 and again at its starting position as in FIG. 1. The tape-tensioning-closing-cutting-means 5 and 5' are in their starting position also.

All movements necessary for the strapping happen in the region of the gap in the supporting surface of the conveying means 1 through which gap the strapping tape 3/3' and the tape positioning means 4 and 4' are moved from their starting position below the supporting surface of the conveying means 1 above this supporting surface.

For this reason, the movement of the tape-tensioning-closing-cutting-means 5 and 5' towards each other is possible only when the tape positioning means 4 and 4' have been moved out of their way, i.e. substantially back into their starting position.

Figure 7:
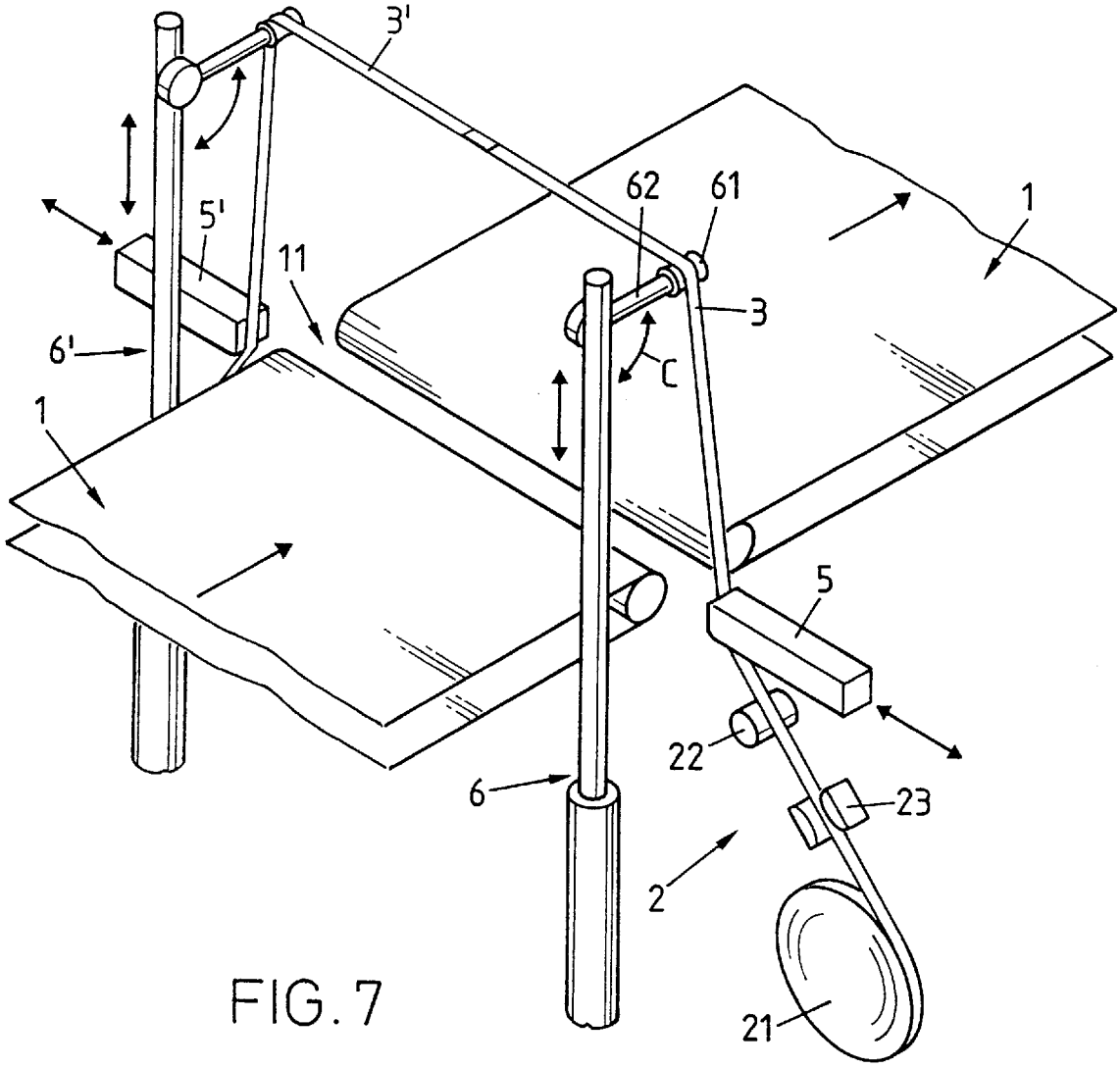
FIG. 7 shows a diagrammatic three dimensional representation of a further device for carrying out the inventive method for transverse strapping (same phase as FIG. 2)

FIG. 7 is a diagrammatic, three-dimensional representation of a further embodiment of the inventive device for transverse strapping. With this embodiment a substantially simultaneous movement of the tape-tensioning-closing-cutting means and of the tape positioning means is possible. This makes it possible to again shorten the time necessary for a strapping cycle.

The device according to FIG. 7 only differs from the device according to FIGS. 1 to 6 regarding the tape positioning means 6 and 6'. The other elements of the device are substantially the same and are denominated with the same reference numbers.

The tape positioning means 6 and 6' are shifted relative to the gap 11 of the conveying means 1 and the tape guide on the distal end of the tape guiding means (here designed as guide roll 61 with an axis arranged perpendicular to the tape) is arranged on a lever 62 projecting substantially in parallel to the conveying path. The lever 62 is pivotal relative to the tape positioning means 6 or 6' (arrow C) into an operative position in which it is shown in FIG. 7 and into a resting position in which the tape guiding roll 61 is pivoted out of the way of the tape, e.g. downward.

When the object to be strapped is positioned below the tape bow extending around the conveying path, the tape guides (61/62) of the tape positioning means 6 and 6' are pivoted into their resting positions. Thus, the tape positioning means 6 and 6' are totally removed out of the region between the object to be strapped and the tape bow and the tape-tensioning-closing-cutting means 5 and 5' can be moved towards each other. At the same time or at a later point in time the tape positioning means 6 and 6' are lowered and when their distal end has reached a position below the tape-tensioning-closing-cutting means 5 and 5' the tape guides (61/62) are pivoted back into their operative position.

Naturally, it would also be possible to arrange the starting position of the tape above the conveying path and, for forming the tape bow, to move the tape by means of a corresponding stroke of the tape positioning means downward to a position below the supporting surface of the object to be strapped. An embodiment of this kind is, however, less advantageous because for adapting the height of the bow to the height of the object to be strapped not only the stroke of the tape positioning means 4 and 4' (or 6 and 6' respectively) but also the height of the tape-tensioning-closing-cutting means 5 and 5' would have to be adjusted.

For one skilled in the art it is possible to design the components of the devices shown in FIGS. 1 to 7 without problem. Therefore, they need not be described in more detail. The drives for the displaceable parts are e.g. pneumatically or hydraulically driven pistons operable in both directions or motor driven rods. In the same way, it is no problem for one skilled in the art to design the control elements for controlling the components for carrying out the inventive strapping.

Instead of supplying the tape from two opposite sides of the conveying path it can also be supplied from only one side and correspondingly held on the other side, e.g. by one of the tape-tensioning-closing-cutting means 5 or 5' such as is known from parallel strapping according to the state of the art.

In particular for strapping stacks, it is advantageous to provide, in addition to the elements shown in FIGS. 1 to 7, means for pressing the stack to be strapped and/or means for laterally stabilizing it.

Figure 8:
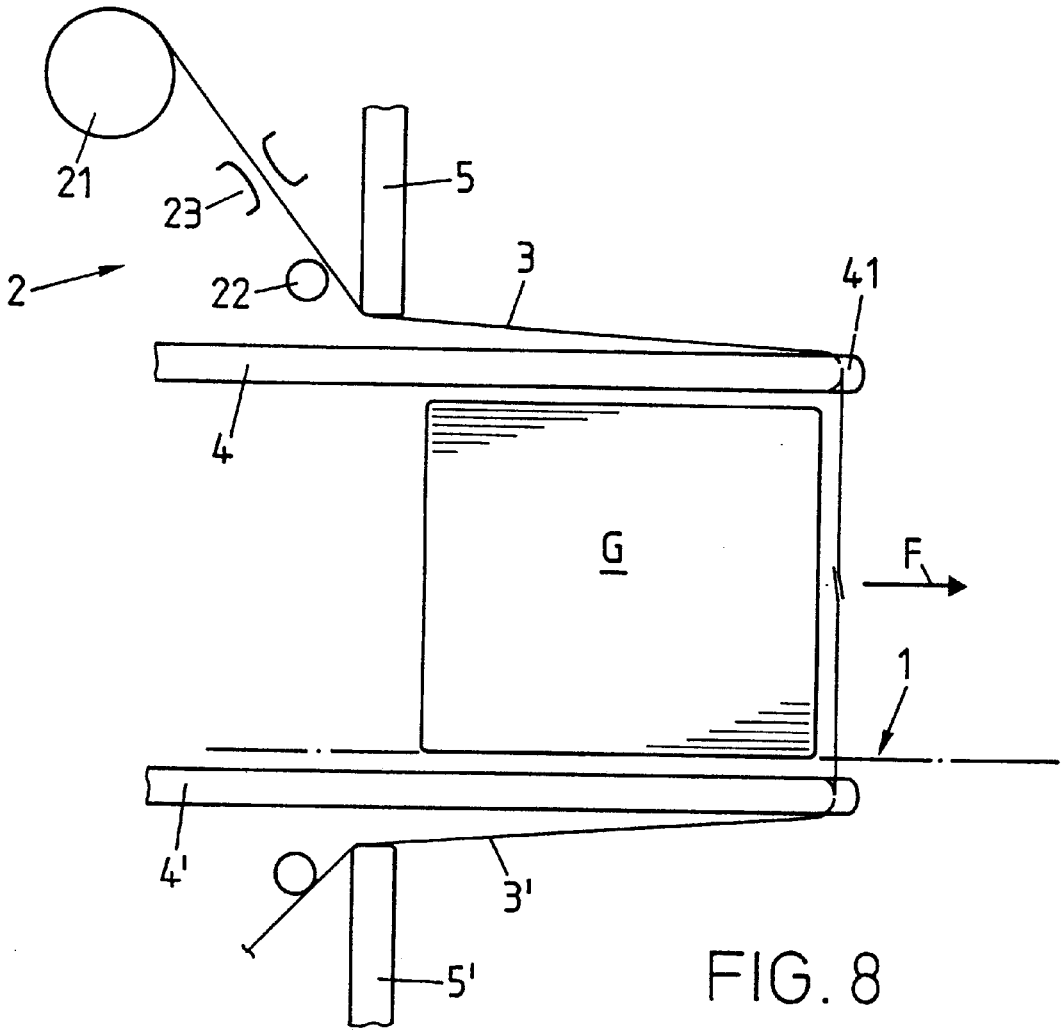
FIGS. 8 and 9 show two exemplified devices for strapping parallel to the conveying direction (parallel strapping)
Figure 9:
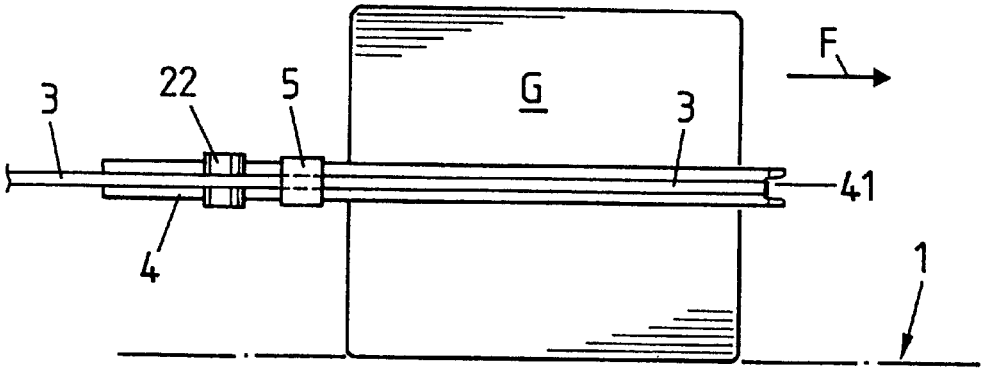

FIGS. 8 and 9 show two exemplified embodiments for parallel strapping (strapping parallel to the conveying direction) according to the inventive method. Both Figures show the same phase of the strapping cycle as FIG. 3, whereby FIGS. 8 and 9 are viewed from an angle perpendicular to the conveying path (arrow F). As most components of the device are the same as described in FIGS. 1 to 7, they are, if they are shown at all, denominated with the same reference numbers.

For the embodiment shown in FIG. 8, the tape positioning means 4 and 4' are arranged above and below the conveying path and their distal end is displaceable in a horizontal direction. In its starting position, the tape 3/3' extends substantially vertical and perpendicular to the conveying direction and e.g. across the middle of the conveying path. The tape bow lies in a substantially vertical plane parallel to the conveying path and is closed on the rear side of the object G to be strapped.

For the embodiment shown in FIG. 9, the tape positioning means 4 and 4' are arranged on the left and on the right of the conveying path and their distal end is displaceable in a horizontal direction. In its starting position, the the tape 3/3' extends substantially horizontally across e.g. the middle of the conveying path. The tape bow lies in a substantially horizontal plane parallel to the conveying path and is closed on the rear side of object G to be strapped.

For the methods for parallel strapping shown in FIGS. 8 and 9, additional pressing and/or lateral stabilizing means can also be provided.

According to the inventive method, on parallel strapping as shown in FIGS. 8 and 9, the tape has no effect on the movement of not yet strapped objects. This means that much more sensitive objects and especially not very stable stacks can be strapped parallel to the conveying direction without problems. This is not easily possible with the known methods for parallel strapping, in which a strapping tape is positioned across the conveying path and is layed around the object to be strapped by the conveying movement of this object.

Figure 10:
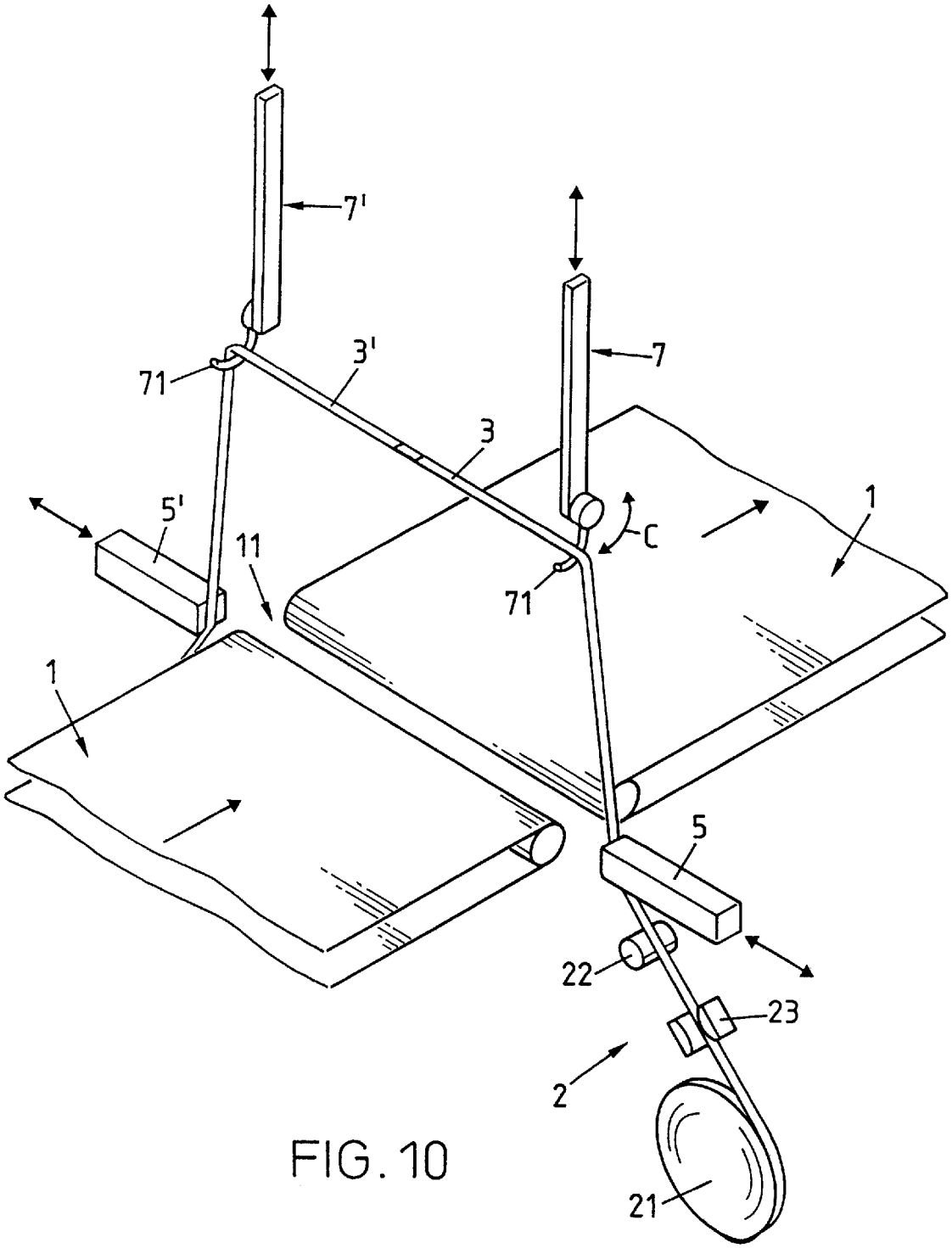
FIG. 10 shows a further embodiment of the inventive device in a diagrammatic three-dimensional representation.

FIG. 10 shows a further exemplified embodiment of the inventive device in the same manner as FIG. 7. This embodiment differs from the ones described so far especially regarding the design of the tape positioning means 7 and 7'.

The other elements of the device are substantially the same ones as described in connection with FIGS. 1 to 7 and are also denominated with the same reference numbers. The tape positioning means 7 and 7' act from above and pull the tape upwards for forming a vertical tape bow (the tape positioning means in FIGS. 1 to 9 push the tape out of its starting position to form the tape bow).

The tape positioning means 7 and 7' again comprise, on their distal ends, e.g. pivotal tape guides 71 in the form of hooks. In an operative position, these grip under the tape and release it by pivoting into a resting position (arrow C). The movable tape guides 71 are advantageously controllable via the tape tension such that they are held in their operative position as long as the tape tension is low or there is no tension and snap into their resting position when the tape tension increases (when the tape-tensioning-closing-cutting means 5 and 5' are activated and the braking means 23 are active). The tape guides 71 are then brought back into an operative position with the help of corresponding control means.

The tape positioning means 7 and 7' according to FIG. 10 can be combined to form one single tape positioning means in the middle which e.g. carries the tape guides on laterally extending arms. The tape positioning means 7 and 7' can additionally be designed as means for pressing and stabilizing an object to be strapped, in particular a stack to be strapped.

In any case, the tape guides (41, 61, 71) arranged on the distal ends of the tape positioning means are the main parts of the tape positioning means (4/4', 6/6', 7/7'). The tape positioning means and the tape guides are in any case arranged and designed such that, for forming the tape bow, the tape guides are movable on each of two opposite sides of the conveying path (perpendicular to the conveying direction for transverse strapping, parallel to the conveying direction for parallel strapping). During this movement the tape guides take the tape with them in a pushing or pulling manner. Furthermore, the tape guides are removable out of the way of the tape after laying it around the object to be strapped.

Crosswise strapping is e.g. achieved by combining the inventive parallel strapping with the inventive transverse strapping e.g. in a combined device. In the same manner, the inventive strapping method and the inventive strapping device can be combined with transverse or parallel strapping methods according to the state of the art.

The central advantage of the inventive method and of the inventive device for transverse strapping, for parallel strapping or for crosswise strapping is its simplicity, the small number of device components to be moved, the simplicity of their movements and the short cycle times due to control of the tape bow according to the format of the object to be strapped such that for tensioning the strapping no tape need be pulled back.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A method for strapping substantially parallelepipedic objects, the method comprising the steps of:

providing a conveying path for conveying the objects in succession to a strapping position and away from the strapping position;

providing two movable tape guides in the strapping position, each of the two movable tape guides being arranged on one of two opposite sides of the conveying path;

supplying a strapping tape to the strapping position, the tape extending in a starting position between said two opposite sides of the conveying path;

forming a tape bow for each object being conveyed into the strapping position by pushing or pulling the tape out of the starting position with the two movable tape guides, the tape bow being adapted to the dimensions of the object;

conveying the object into the tape bow;

moving the two movable tape guides out of the way of the tape;

tensioning and closing the tape around the object;

separating the tape closed around the object from the tape extending across the conveying path to reestablish the starting position of the tape; and conveying the object away from the strapping position.

2. The method according to claim 1, further comprising the step of providing the objects as stacks of flat articles.

3. The method according to claim 1, further comprising the steps of:

extending the tape in the starting position below the conveying path;

forming the tape bow substantially vertical; and strapping the object substantially perpendicular to the conveying direction.

4. The method according to claim 1, further comprising the steps of:

extending the tape in the starting position vertically or horizontally across the conveying path; and strapping the object substantially parallel to the conveying path.

5. The method according to claim 1, further comprising the step of supplying the tape from said two opposite sides of the conveying path or from only one side of the conveying path.

6. The method according to claim 1, further comprising the steps of:

arranging means for tensioning, closing and separating the tape on the two opposite sides of the conveying path; and moving the means for tensioning, closing and separating the tape against each other to tension, close and separate the tape.

7. The method according to claim 6, further comprising the step of moving the means for tensioning, closing and separating the tape at least partly simultaneously with the tape guides.

8. A device for strapping substantially parallelepipedic objects, the device comprising:

means for conveying the objects along a conveying path in succession to a strapping position and away from the strapping position;

tape supply means for supplying a tape in the strapping position, extending in a starting position between two opposite sides of the conveying path;

two movable tape guides for forming a tape bow by pushing or pulling the tape out of the starting position, each of the tape guides being arranged on one of said two opposite sides of the conveying path and being controllable according to the dimensions of the object;

means for tensioning and closing the tape bow in the strapping position, around the object and for separating the tape bow from the tape extending between said two opposite sides of the conveying path.

9. The device according to claim 8, wherein said tape guides are movable perpendicular or parallel to the conveying path.

10. The device according to claim 8, wherein said tape guides are positioned at distal ends of tape positioning means.

11. The device according to claim 8, wherein said tape guides are grooves or guide rolls movable for pushing the tape, or hooks movable for pulling the tape.

12. The device according to claim 8, wherein a distance between the tape guides is adjustable to a width of the object to be strapped.

13. The device according to claim 8, wherein said tape guides are pivotable relative to tape positioning means.

14. The device according to claim 8, wherein said tape supply means are arranged on said two opposite sides of the conveying path or only one side of the conveying path.

15. The device according to claim 14, wherein said tape supply means comprises a storage reel, a guide roller and means for braking the tape.

* * * * *